US005205491A

United States Patent [19]

Hadar

[11] Patent Number: 5,205,491

[45] Date of Patent: Apr. 27, 1993

[54] STATIC SECTOR-TYPE WATER SPRINKLER

[75] Inventor: Yoram Hadar, Haifa, Israel

[73] Assignee: Lego M. Lemelshtrich Ltd., Natania, Israel

[21] Appl. No.: 801,133

[22] Filed: Dec. 2, 1991

[30] Foreign Application Priority Data

Dec. 5, 1990 [IL] Israel ..... 96547

[51] Int. Cl.[5] ..... B05B 1/32

[52] U.S. Cl. ..... 239/457; 239/598; 239/581.2; 239/DIG. 1

[58] Field of Search ..... 239/200, 201, 451, 455–458, 239/460, DIG. 1, 581.1, 581.2, 582.1, 538, 539, 597, 598

[56] References Cited

U.S. PATENT DOCUMENTS

| | | | |
|---|---|---|---|
| 4,119,275 | 10/1978 | Hunter | 239/DIG. 1 |
| 4,184,239 | 1/1980 | Clawson | 29/157 C |
| 4,189,099 | 2/1980 | Bruninga | 239/200 |
| 4,579,285 | 4/1986 | Hunter | 239/457 |
| 4,625,917 | 12/1986 | Torney | 239/DIG. 1 |
| 4,739,934 | 4/1988 | Gewelber | 239/DIG. 1 |
| 4,850,538 | 7/1989 | Krahn | 239/439 |
| 5,058,806 | 10/1991 | Rupar | 239/206 |
| 5,083,709 | 1/1992 | Iwanowski | 239/DIG. 1 |

*Primary Examiner*—Andres Kashnikow
*Assistant Examiner*—Karen B. Merritt
*Attorney, Agent, or Firm*—Benjamin J. Barish

[57] ABSTRACT

A static, sector-type water sprinkler producing a variable-sector water-distribution pattern, includes an outlet opening having an effective length around the circumference of its housing which may be manually varied for preselecting the sector angle of the water distribution around the sprinkler. The outlet opening is defined by a helical slot, and its effective lenth is varied by a blocking member which is manually movable with respect to the slot to preselect the portion thereof to be unblocked, and thereby the sector angle of the water to be distributed around the sprinkler.

19 Claims, 3 Drawing Sheets

STATIC SECTOR-TYPE WATER SPRINKLER

FIELD AND BACKGROUND OF THE INVENTION

The present invention relates to water sprinklers, and particularly to a static, sector-type water sprinkler producing a variable-sector water-distribution pattern around the sprinkler.

Variable-sector water sprinklers of this type are known. Generally, they include a housing formed with an inlet opening at one end connectible to a supply of pressurized water, and an outlet opening having an effective length around the circumference of the housing which may be manually varied for preselecting the sector angle of the water distribution around the sprinkler. An example of a known sprinkler of this type is illustrated in U.S. Pat. No. 4,579,285. However, efforts are continuously being made to improve the performance of such sprinklers, and to reduce the cost in their manufacture and maintenance.

OBJECTS AND BRIEF SUMMARY OF THE INVENTION

An object of the present invention is to provide a static, sector-type water sprinkler having advantages in one or more of the above respects.

According to the present invention, there is provided a static, sector-type water sprinkler producing a variable-sector water-distribution pattern, including a housing formed with an inlet opening at one end connectible to a supply of pressurized water, and an outlet opening having an effective length around the circumference of the housing which may be varied for preselecting the sector angle of the water distribution around the sprinkler; characterized in that the outlet opening is defined by a slot extending helically around substantially the complete circumference of the housing; and in that the sprinkler further includes a blocking member movable with respect to the slot to preselect the portion thereof to be unblocked by the blocking member, and thereby the sector angle of the water distribution around the sprinkler.

The sprinkler of the present invention sharply distinguishes in both structure, and method of presetting the sector of water distribution, from the sprinkler described, for example, in U.S. Pat. No. 4,579,285. Thus, in the sprinker of the above patent, the outlet opening or orifice is defined by circular peripheral edges having axially offset ends formed in two relatively rotatable members, so that rotating one member with respect to the other increases or decreases the circumferential length of the outlet opening. In the present invention, however, the outlet opening is defined by a helical slot, and the sector of water distribution is varied by a blocking member movable with respect to the slot to preselect the portion of the slot to be unblocked, and thereby the sector angle of the water distribution around the sprinkler.

According to further features in the preferred embodiment of the invention described below, the blocking member is disposed within a cylindrical bore extending axially of the housing and rotatable therein to preselect the portion of the slot to be unblocked, and thereby the sector angle of the water distribution around the housing. More particularly, in the described preferred embodiment, the outer face of the blocking member is formed with a helical rib receivable in the helical slot to preselect the portion of the slot to be unblocked according to the rotated position of the blocking member and its helical rib.

According to a further feature of the invention, the portion of the housing defining the upper surface of the helical slot is formed with a plurality of radially-extending ribs. Such ribs direct the water radially outwardly, thereby increasing the range and producing a more uniform water distribution.

According to further features in the described preferred embodiment, the blocking member is formed with a non-circular (e.g., a hexagonal) bore extending axially of the blocking member, and the sprinkler includes a corresponding non-circular stem extending through the bore and having an externally-accessible finger-gripping element to facilitate manual rotation of the blocking member in order to preselect the sector angle of the water distribution around the sprinkler.

According to a further feature in the described preferred embodiment, the stem carries a flow control element adjacent the inlet opening of the housing and presettable towards and away therefrom to preset the size of the inlet opening, and thereby the rate of flow of the water therethrough.

Water sprinklers constructed in accordance with the foregoing features may be manufactured and assembled in volume and at low cost.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF PREFERRED EMBODIMENTS

Figure 1:
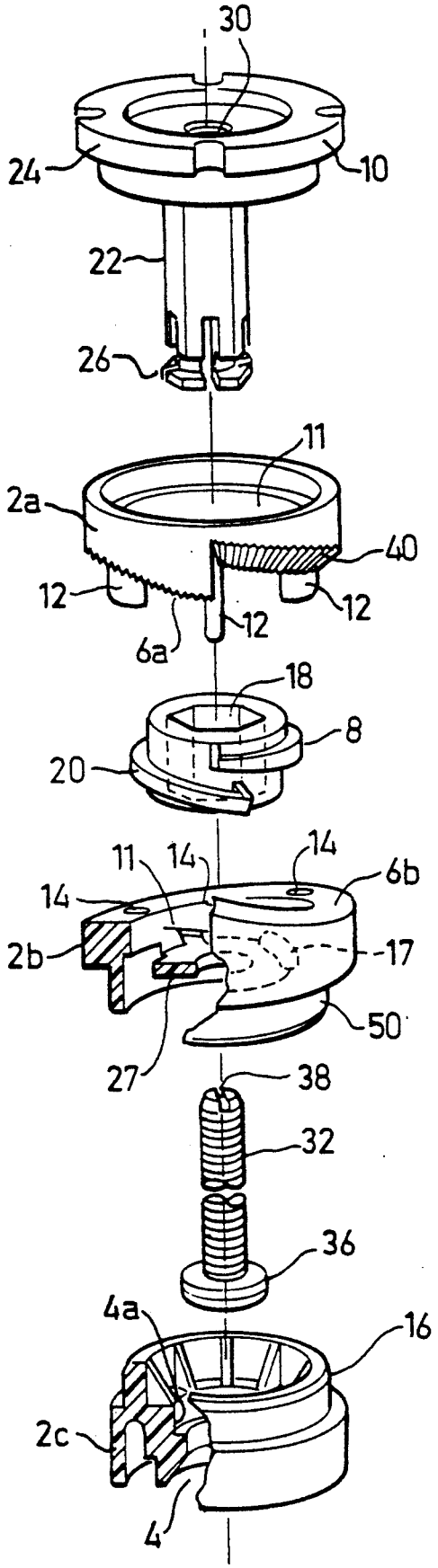
FIG. 1 is an exploded view illustrating the main elements of one form of sprinkler constructed in accordance with the present invention.
Figure 2:
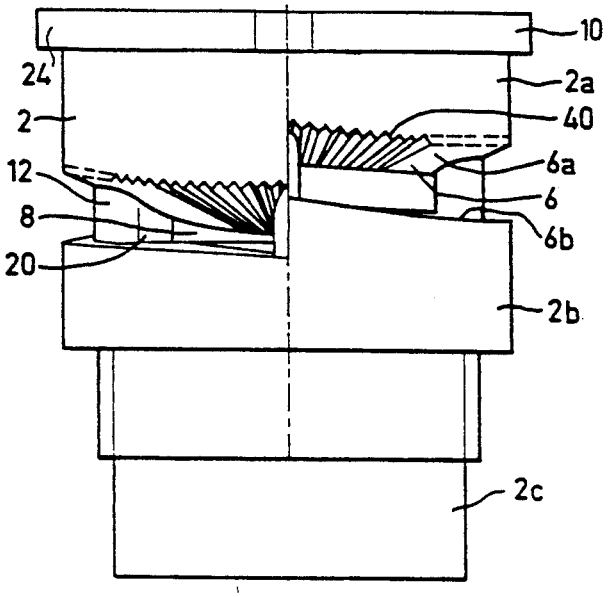
FIG. 2 is a side elevational view illustrating the sprinkler of FIG. 1 in assembled condition.
Figure 3:
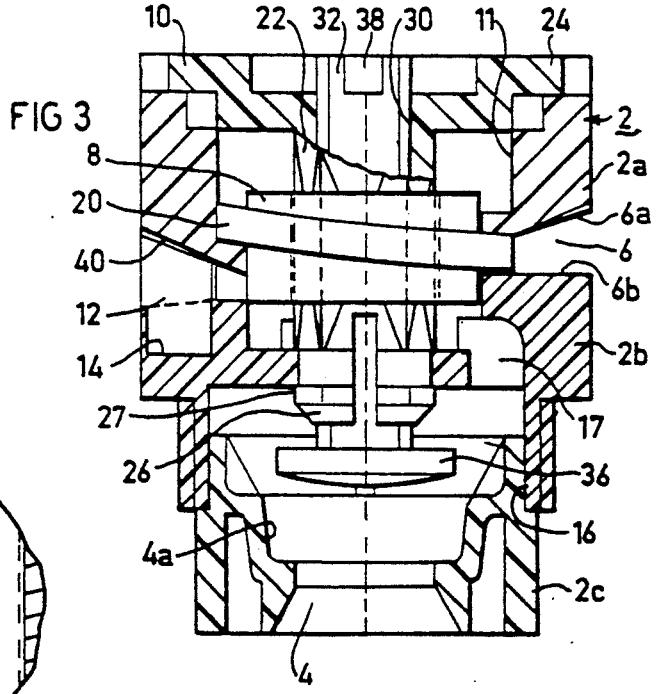
FIG. 3 is a longitudinal sectional view of the sprinkler of FIG. 2.

The sprinkler illustrated in FIGS. 1–4 is a static, sector-type water sprinkler producing a water-distribution pattern which may be manually varied both with respect to the sector, and the rate of water distribution, around the sprinkler. The illustrated sprinkler comprises a housing, generally designated 2, formed with an inlet opening 4 (FIG. 3) at one end connectible to a supply of pressurized water, and a helical slot 6 (FIG. 2) extending helically around the circumference of the housing and serving as an outlet opening for discharging the water around the sprinkler. While helical slot 6 is of fixed length, the effective size of the slot discharging the water may be varied by a blocking member, generally designated 8 (FIG. 1), manually movable with respect to the slot to preselect the portion thereof to be unblocked by the blocking member, and thereby the sector angle of the water distribution around the sprinkler.

Presetting the sector is effected by a manually-rotatable stem assembly, generally designated 10, which may be rotated to thereby rotate the blocking member 8. Housing 2 is formed with an axially-extending bore 11 for receiving the stem assembly 10.

More particularly, housing 2 is constituted of three sections 2a, 2b and 2c. Housing section 2a is formed with the upper surface 6a of the helical slot 6, whereas housing section 2b is formed with the lower surface 6b of the helical slot. The two sections 2a, 2b, with the blocking member 8 in between, are secured together by a plurality of posts 12 formed in the lower surface of housing section 2a received within blind bores 14 in housing section 2b. Housing section 2c is integrally formed with inlet opening 4 and is secured to housing section 2b by a friction fit, wherein the smooth outer surface 16 in housing section 2c is frictionally received within the smooth inner surface in the lower end of housing section 2b. Housing section 2b is formed with recesses 17 on its inner surface which define flow passageways from the inlet 4 to the blocking member 8.

Blocking member 8 is of generally cylindrical configuration to be snugly received within the two housing sections 2a, 2b when secured together. The blocking member is formed with a central axially-extending bore 18 of non-circular (e.g., hexagonal) configuration, and an outer rib 20 extending helically around its circumference. Helical rib 20 is of a configuration corresponding to that of helical slot 6, and is of a height equal to the height of that slot, so as to be snugly receivable and movable within that slot.

Stem assembly 10 includes a stem 22 of the same cross-section (e.g., hexagonal) as axial bore 18 formed in blocking member 8 so as to be non-rotatably receivable within the blocking member. Assembly 10 further includes a circular collar 24 at one end of stem 22, and a plurality of lugs 26 at the opposite end of the stem. The outer end of collar 24 forms an externally-accessible finger-gripping element permitting stem 22, as well as blocking member 8 received thereon, to be rotated in order to move the helical rib 20 of blocking member 8 within the helical slot 6 of the housing 2.

Lugs 26 form an annular abutment engageable with an annular shoulder 27 (FIG. 3) in the housing adjacent the inlet opening 4. These lugs permit rotational movement, but not axial movement, of stem 22 within the housing. As shown particularly in FIG. 3, lugs 26 are formed with outer tapered surfaces permitting the stem to be inserted with a snap-fit into the axial bore 11 defined by the housing 2.

Stem assembly 10 is further formed with a threaded, axially-extending bore 30 for receiving an externally-threaded pin 32. As shown particularly in FIG. 3, the inner end of pin 32 is formed with an enlarged head 36 to be located adjacent to the throat 4a of the sprinkler inlet 4. The opposite (outer) end of pin 32 is formed with a screwdriver slot 38.

Head 36 of pin 32 thus serves as a flow-control element which is movable, upon rotation of pin 32, towards or away the inlet throat 4a for presetting the size of the inlet opening, and thereby the rate of flow of the water therethrough to the sprinkler and the range of the sprinkler.

Figure 4:
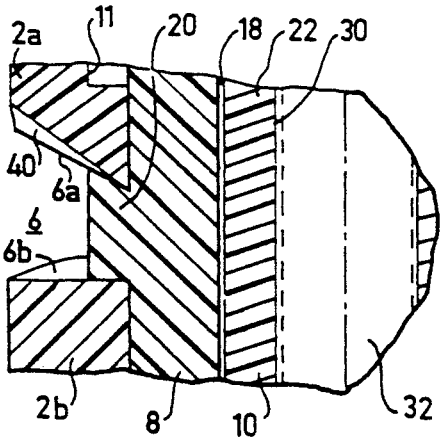
FIG. 4 is an enlarged fragmentary view of a portion of the sprinkler of FIGS. 1–3.

As particularly seen in FIG. 4, both the upper surface 6a and the lower surface 6b of, the helical slot 6 are tapered outwardly to produce an upwardly-inclined spray-pattern of the water discharged through the helical slot. In addition, the upper surface 6a of the helical slot is formed with a plurality of radially-extending ribs 40 which tend to direct the discharged water to the radial direction, thereby increasing the range of water discharge, and also to move the water discharge more uniformly over the preselected sector.

The lower end of housing section 2c is internally threaded for attaching the sprinkler to a vertical riser.

The sprinkler is assembled as follows:

Blocking member 8 is inserted between the two housing sections 2a, 2b, and then the two housing sections are secured together by inserting posts 12 of section 2a into openings 14 of section 2b. The two sections may be secured removably by a friction fit, or permanently by adhesive or heat-welding.

Stem assembly 10 is then inserted through bore 11 of the housing, and through bore 18 of the blocking member 8. This insertion is facilitated by the flexible lugs 26 and by their outer tapered surfaces, which permit the assembly to be inserted with a snap-fit with the lugs engaging annular surface 27 (FIG. 3) of the housing. Pin 32 is then threaded into stem 22 from its bottom.

The assembled two housing sections 2a, 2b, with the blocking member 8, stem assembly 10 and pin 32 in between, are then assembled to the lower housing section 2c by press-fitting the outer smooth surface 16 in the latter section within the internal smooth surface of section 2b.

The sprinkler may then be preset to provide the desired sector of water-distribution, and also the desired rate of water distribution, as follows:

To preset the sector, collar 24 is rotated, which thereby moves helical rib 20 of blocking member 8 more or less within helical slot 6 of the housing, such that the portion of the helical slot not blocked by the helical rib determines the sector angle of the water distribution around the sprinkler.

The rate of water distribution may be preset externally, e.g., by inserting a screwdriver or other tool into slot 38 of pin 32, and rotating the pin, which will thereby move head 36 at the opposite end of the stem assembly 10 towards or away from throat 4a of the inlet opening 4.

It will be seen that in the FIGS. 1–4 embodiment, the helical slot 6 is not continuous, but rather is interrupted by the three posts 12 connecting housing section 2a to housing section 2b. The posts may be of an oblong cross-section to minimize this interference. In most cases, they will not substantially interfere with the water distribution pattern around the sprinkler, since the angular length of all the posts together is at least an order of magnitude smaller than the angular length of the helical slot (e.g., the circumference of the housing).

Figure 5:
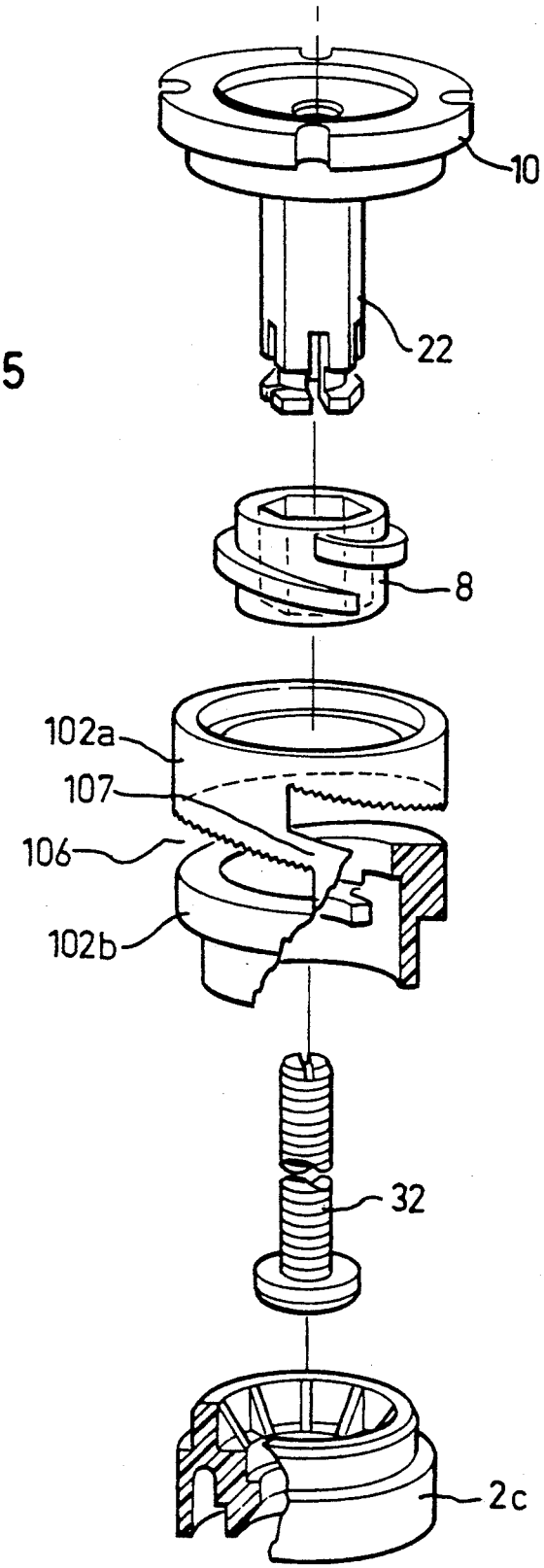
FIG. 5 is an exploded view illustrating a modification in the construction of the sprinkler of FIGS. 1–4.

FIG. 5 illustrates a variation wherein the helical slot, therein designated 106, is not interrupted, but rather is continuous for its complete length around the circumference of the housing. The two housing sections 102a, 102b are integrally joined together as one part, e.g., by injection molding. In this construction, the opposite ends of the helical slot 106 overlap and are interconnected by a web portion 107.

In all other respects, the construction, presetting, and operation of the sprinkler illustrated in the modification of FIG. 5 are otherwise the same as described above with respect to FIGS. 1–4, and therefore the corresponding parts are identified by the same reference numbers.

While the invention has been described with respect to one preferred embodiment, including a modification, it will be appreciated that many other variations, modifications and applications of the invention may be made.

What is claimed is:

1. A static, sector-type water sprinkler producing a variable-sector water-distribution pattern, including a housing formed with an inlet opening at one end connectible to a supply of pressurized water, and an outlet opening having an effective length around the circumference of the housing which may be varied for preselecting the sector angle of the water distribution around the sprinkler;

characterized in that said outlet opening is defined by a slot extending helically around substantially the complete circumference of the housing; and in that said sprinkler further includes a blocking member movable with respect to said slot to preselect the portion thereof to be unblocked by said blocking member, and thereby the sector angle of the water distribution around the sprinkler.

2. The sprinkler according to claim 1, wherein said slot is interrupted by a plurality of posts joining together the portions of the housing on the opposite sides of the slot, all of said posts together occupying an angular length which is at least on order of magnitude smaller than the circumference of the housing.

3. The sprinkler according to claim 1, wherein said slot is continuous for its complete length around the circumference of the housing.

4. The sprinkler according to claim 1, wherein said blocking member is disposed within a cylindrical bore extending axially of the housing and is rotable therein to preselect the portion of said slot to be unblocked, and thereby the sector angle of the water distribution around the sprinkler.

5. The sprinkler according to claim 4, wherein the outer face of said blocking member is formed with a helical rib receivable in said helical slot to preselect the portion of said slot to be unblocked according to the rotated position of the blocking member and its helical rib.

6. The sprinkler according to claim 5, wherein said blocking member is formed with a non-circular bore extending axially thereof, and said sprinkler includes a non-circular stem extending through said non-circular bore and having an externally-accessible finger-gripping element to facilitate manual rotation of said blocking member in order to preselect the sector angle of the water distribution around the sprinkler.

7. The sprinkler according to claim 6, wherein said externally-accessible finger-gripping element is a circular collar fixed to one end of said stem, the opposite end of the stem being formed with an annular abutment engageable with an annular shoulder formed on the housing adjacent to said inlet opening, permitting rotational movement, but not axial movement, of said stem within said housing.

8. The sprinkler according to claim 7, wherein said annular abutment formed at said opposite end of the stem is defined by a plurality of flexible lugs formed with outer tapered surfaces permitting said stem to be inserted with a snap-fit into said axial bore of the housing.

9. The sprinkler according to claim 7, wherein said opposite end of the stem carries a flow control element adjacent the inlet opening of the housing and presettable towards and away therefrom to preset the size of the inlet opening and thereby the rate of flow of the water therethrough.

10. The sprinkler according to claim 9, wherein said flow control element is carried by an externally-threaded pin received in an internally threaded bore formed in said stem and accessible from said one end of the stem for presetting the position of the flow control element.

11. The sprinkler according to claim 10, wherein said flow control element is in the form of an enlarged head carried by the end of said externally-threaded pin at said opposite end of the stem.

12. The sprinkler according to claim 1, wherein the portion of said housing formed with said helical slot includes a first section formed with one surface of said slot, and a second section formed with the other surface of said slot; said first section being further formed with a plurality of circumferentially-spaced posts fixed within bores formed in said second section.

13. The sprinkler according to claim 1, wherein the portion of said housing formed with said slot is constituted of a single integral part.

14. The sprinkler according to claim 13, wherein the portion of said housing formed with said inlet opening is in a separate section joined to the portion of said housing formed with said helical slot.

15. The sprinkler according to claim 1, wherein the portion of the housing defining the upper surface of said helical slot is formed with a plurality of radially-extending ribs.

16. A static, sector-type water sprinkler producing a variable-sector water-distribution pattern, comprising:

a housing formed with an inlet opening at one end connectible to a supply of pressurized water, and an outlet opening having an effective length around the circumference of the housing which may be manually varied for preselecting the sector angle of the water distribution around the sprinkler;

said outlet opening being defined by a slot of fixed length extending helically around substantially the complete circumference of the housing;

said sprinkler further including a blocking member manually movable with respect to said slot to preselect the portion thereof to be unblocked by said blocking member, and thereby the sector angle of the water distribution around the sprinkler.

17. The sprinkler according to claim 16, wherein said blocking member is disposed within a cylindrical bore extending axially of the housing and is rotable therein to preselect the portion of said slot to be unblocked, and thereby the sector angle of the water distribution around the sprinkler.

18. The sprinkler according to claim 17, wherein the outer face of said blocking member is formed with a helical rib receivable in said helical slot to preselect the portion of said slot to be unblocked according to the rotated position of the blocking member and its helical rib.

19. The sprinkler according to claim 16, wherein said blocking member includes a stem carrying a flow control element adjacent the inlet opening of the housing and presettable towards and away therefrom to preset the size of the inlet opening and thereby the rate of flow of the water therethrough.

* * * * *